US007789053B2

(12) United States Patent
Kong et al.

(10) Patent No.: US 7,789,053 B2
(45) Date of Patent: Sep. 7, 2010

(54) CONTINUOUS VARIABLE VALVE LIFT APPARATUS

(75) Inventors: Jin Kook Kong, Suwon (KR); Won Geun Lee, Seongnam (KR); Kyoung Joon Chang, Seongnam (KR); Kiyoung Kwon, Seoul (KR); Young Hong Kwak, Suwon (KR); Ki Uk Shin, Hwaseong (KR); Eun Ho Lee, Hwaseong (KR); Young Nam Kim, Seongnam (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 391 days.

(21) Appl. No.: 12/108,291

(22) Filed: Apr. 23, 2008

(65) Prior Publication Data

US 2008/0314344 A1 Dec. 25, 2008

(30) Foreign Application Priority Data

Jun. 25, 2007 (KR) ..... 10-2007-0062437
Dec. 10, 2007 (KR) ..... 10-2007-0127688

(51) Int. Cl.
*F01L 1/34* (2006.01)

(52) U.S. Cl. ..... 123/90.16; 123/90.31; 123/90.39; 123/90.44; 74/569

(58) Field of Classification Search ..... 123/90.16, 123/90.31, 90.39, 90.44; 74/559, 567, 569
See application file for complete search history.

(56) References Cited

U.S. PATENT DOCUMENTS 7,213,551 B2 * 5/2007 Asada et al. ..... 123/90.16

* cited by examiner

*Primary Examiner*—Ching Chang
(74) *Attorney, Agent, or Firm*—Morgan, Lewis & Bockius LLP

(57) ABSTRACT

A continuous variable valve lift apparatus according to an exemplary embodiment of the present invention includes a camshaft, an input cam disposed to the camshaft, a variable lever that is rotably connected to the camshaft and includes a first arm including a first connecting shaft and a second arm including a second connecting shaft, a first link rotating around the first connecting shaft corresponding to a rotation of the input cam, an output cam rotating around the camshaft, a valve opening/closing portion that is opened and closed corresponding to a rotation of the output cam, and a connecting portion that is disposed for the output cam to rotate corresponding to a rotation of the first link.

32 Claims, 14 Drawing Sheets

CONTINUOUS VARIABLE VALVE LIFT APPARATUS

CROSS-REFERENCE TO RELATED APPLICATION

This application claims priority to and the benefit of Korean Patent Application No. 10-2007-0062437 filed in the Korean Intellectual Property Office on Jun. 25, 2007, and Korean Patent Application No. 10-2007-0127688 filed in the Korean Intellectual Property Office on Dec. 10, 2007, the entire contents of which are incorporated herein by reference.

BACKGROUND OF THE INVENTION (a) Field of the Invention

The present invention relates to a continuous variable valve lift apparatus, more particularly, a continuous variable valve lift apparatus that can adjust a valve lift amount in response to an operational state of an engine.

(b) Description of the Related Art

Generally, an automotive engine includes a combustion chamber in which fuel burns to generate power. The combustion chamber is provided with an intake valve for supplying a gas mixture containing the fuel and an exhaust valve for expelling the burned gas. The intake and exhaust valves open and close the combustion chamber by a valve lift apparatus connected to a crankshaft.

A conventional valve lift apparatus has a fixed valve lift amount using a cam formed in a predetermined shape. Therefore, it is impossible to adjust the amount of a gas mixture that is being introduced or exhausted. Therefore, the engine does not run at its optimal efficiency in various driving ranges.

For example, as a conventional art, if a valve lift apparatus is designed to optimally respond to a low driving speed, the valve open time and amount are not sufficient for a high speed driving state. On the contrary, when the valve lift apparatus is designed to optimally respond to a high speed driving state, an opposite phenomenon occurs in the low speed driving state.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a continuous variable valve lift apparatus having a wide range of operation.

A continuous variable valve lift apparatus according to exemplary embodiments of the present invention may use the same camshaft of a general valve lift apparatus without changing other structures of a valve train.

A continuous variable valve lift apparatus according to a first exemplary embodiment of the present invention may include a camshaft, an input cam disposed to the camshaft, a variable lever that is rotably connected to the camshaft and includes a first arm including a first connecting shaft and a second arm including a second connecting shaft, a first link coupled to the first connecting shaft and rotating corresponding to a rotation of the input cam, an output cam coupled to the camshaft, a valve opening/closing portion that is opened and closed corresponding to a rotation of the output cam, and a connecting portion coupled to the second arm of the variable lever and rotating corresponding to a rotation of the first link.

The first link may include a first roller that contacts the input cam at one end of the first link and a second roller that contacts the connecting portion at the other end of the first link.

The connecting portion may include a second link that rotates around the second connecting shaft and transmits rotation of the first link to the output cam.

The second link may be disposed between the first link and the output cam. The second link may include a third roller at one end of the second link for contacting the output cam.

A control portion may control a position of the variable lever, and the control portion may include a control motor and a worm gear that connects the control motor and the variable lever.

The output cam may comprise a first portion, a second portion, and a trigger portion. The first portion, which contacts the valve opening/closing portion in a valve-closed state, is formed at a constant distance from the camshaft and the second portion, which contacts the valve opening/closing portion in a valve-opened state, is formed in a direction away from the camshaft. The trigger portion is formed to extend in a radial direction away from the rotation center of the output cam.

A return spring may be disposed for supplying restoring force to the output cam.

The valve opening/closing portion may include a valve and a tappet that is connected to the valve and opens and closes the valve corresponding to a rotation of the output cam.

According to a second exemplary embodiment of the present invention, the connecting portion may include a second link and rotate around the second connecting shaft in response to rotation of the first link and a third link that is connected with the second link and the output cam and turns the output cam.

According to a third exemplary embodiment of the present invention, the valve opening/closing portion may include a valve, a swing arm that is connected to the valve, a hydraulic lash adjuster that supports the swing arm, and a needle bearing that receives a rotation of the output cam, reciprocates up and down, and opens and closes the valve.

According to a fourth exemplary embodiment of the present invention, an auxiliary cam may be disposed to the camshaft for reverting to the former state after the first link turns the output cam.

A mounting portion may be formed to the first link for the first link reverting to the former state corresponding to a rotation of the auxiliary cam.

The mounting portion may include a mounting bracket and a clearance adjusting screw for adjusting clearance between the auxiliary cam and the first link.

The first link may include a first roller that contacts the input cam at one end of the first link and a second roller that contacts the connecting portion at the other end of the first link.

The connecting portion may include a second link and rotate around the second connecting shaft in response to rotation of the first link and a third link that is connected with the second link and the output cam and turns the output cam.

An auxiliary link may be formed to the second link for preventing the first link from separating from the second link.

The valve opening/closing portion may be a direct drive valve.

According to a fifth exemplary embodiment of the present invention, the valve opening/closing portion may be a swing-arm valve.

According to a sixth exemplary embodiment of the present invention, a fourth link may be formed to the first link for the first link to revert to the former state corresponding to a rotation of the auxiliary cam.

A fourth roller may be disposed to the fourth link to contact the auxiliary cam.

A clearance adjusting screw may be disposed to the first link for adjusting clearance between the fourth link and the first link.

The first link may include a first roller that contacts the input cam at one end of the first link and a second roller that contacts the connecting portion at the other end of the first link.

The connecting portion may include a second link and rotate around the second connecting shaft in response to rotation of the first link; and a third link, which is connected with the second link and the output cam, and turns the output cam.

An auxiliary link may be formed to the second link for preventing the first link from separating from the second link.

A continuous variable valve lift apparatus according to a sixth exemplary embodiment of the present invention may include a camshaft, a plurality of input cams disposed to the camshaft, a plurality of variable levers that are rotably connected to the camshaft and include a first arm including a first connecting shaft and a second arm including a second connecting shaft, respectively, a control portion that controls an angle between the variable lever and a horizon, a plurality of the first links coupled to the first connecting shaft and rotating in response to rotations of the plurality of input cams, a plurality of the second links rotating around the second connecting shaft corresponding to rotations of the plurality of first links, a plurality of output cams rotating around the camshaft corresponding to rotations of the plurality of second links, and a plurality of valve opening/closing portions that are opened and closed corresponding to rotations of the plurality of output cams, wherein the plurality of variable levers are connected to each other by a lever connecting shaft and are controlled by the control portion. The continuous variable valve lift apparatus according to a sixth exemplary embodiment of the present invention may further include an auxiliary cam that is disposed to the camshaft for reverting to the former state after the first link turns the output cam.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
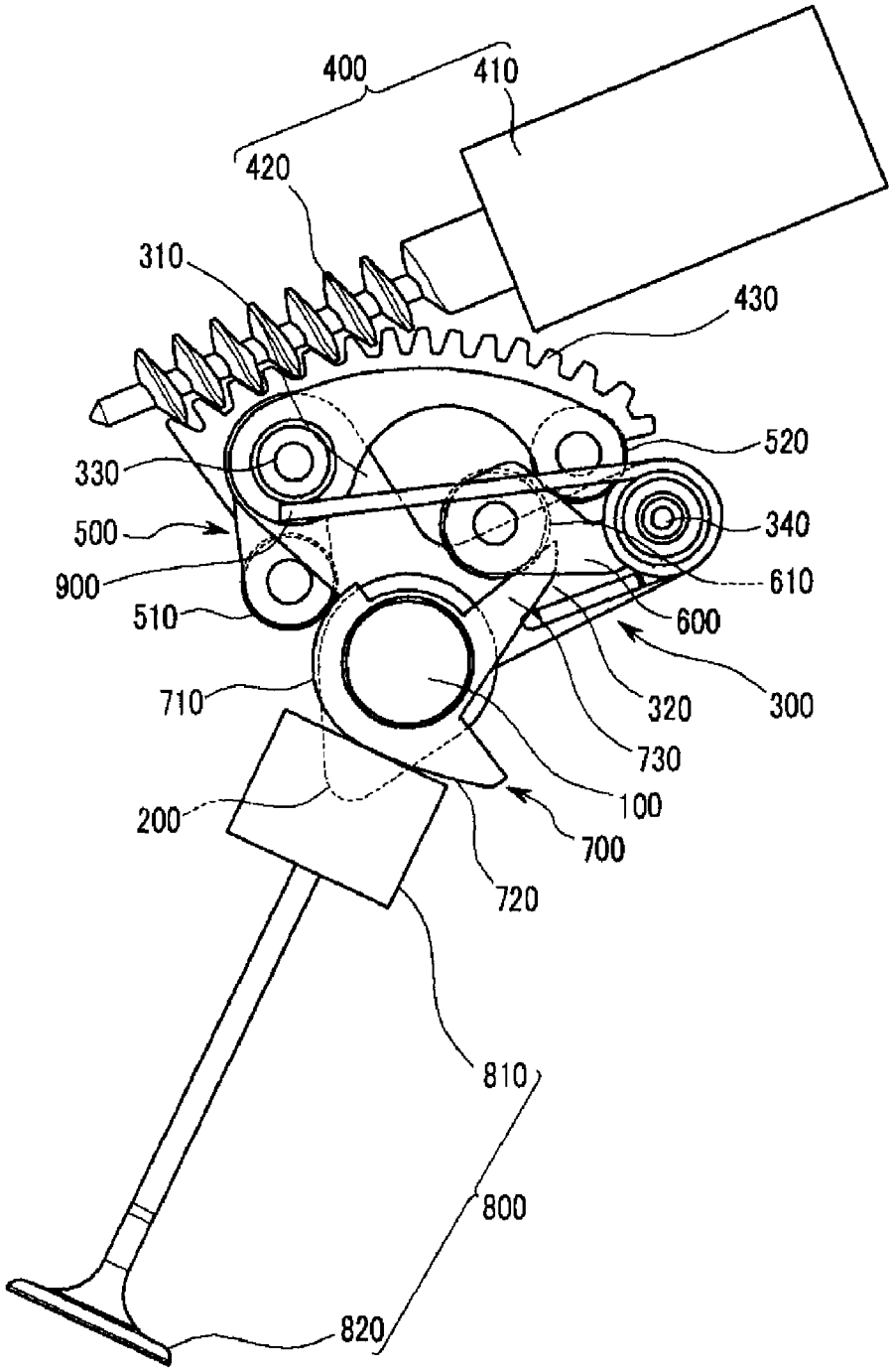
FIG. 1 is a front view showing a scheme of a continuous variable valve lift apparatus according to the first exemplary embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DESCRIPTION OF REFERENCE NUMERALS INDICATING PRIMARY ELEMENTS IN THE DRAWINGS

100,101,105: camshaft
200,201,205: input cam
250: auxiliary cam
300,301,305: variable lever
310,311,315: first arm
320,321,325: second arm
330,331,335: first connecting shaft
340,341,345: second connecting shaft
400: control portion
410: control motor
420: worm
430: worm wheel
450: clearance adjusting screw
500,501: first link
510,511: first roller
520,521: second roller
600,601: second link
602, 603: auxiliary link
610: third roller

650,651: third link
700,701,702,703,705: output cam
710,711,740; first portion
720,721,750: second portion
730: trigger portion
800,801,802,803: valve opening/closing portion
810: tappet
820,850: valve
830: hydraulic lash adjuster
840: swing arm
860: needle bearing
900: return spring

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Exemplary embodiments the present invention will be described more fully hereinafter with reference to the accompanying drawings.

Figure 2:
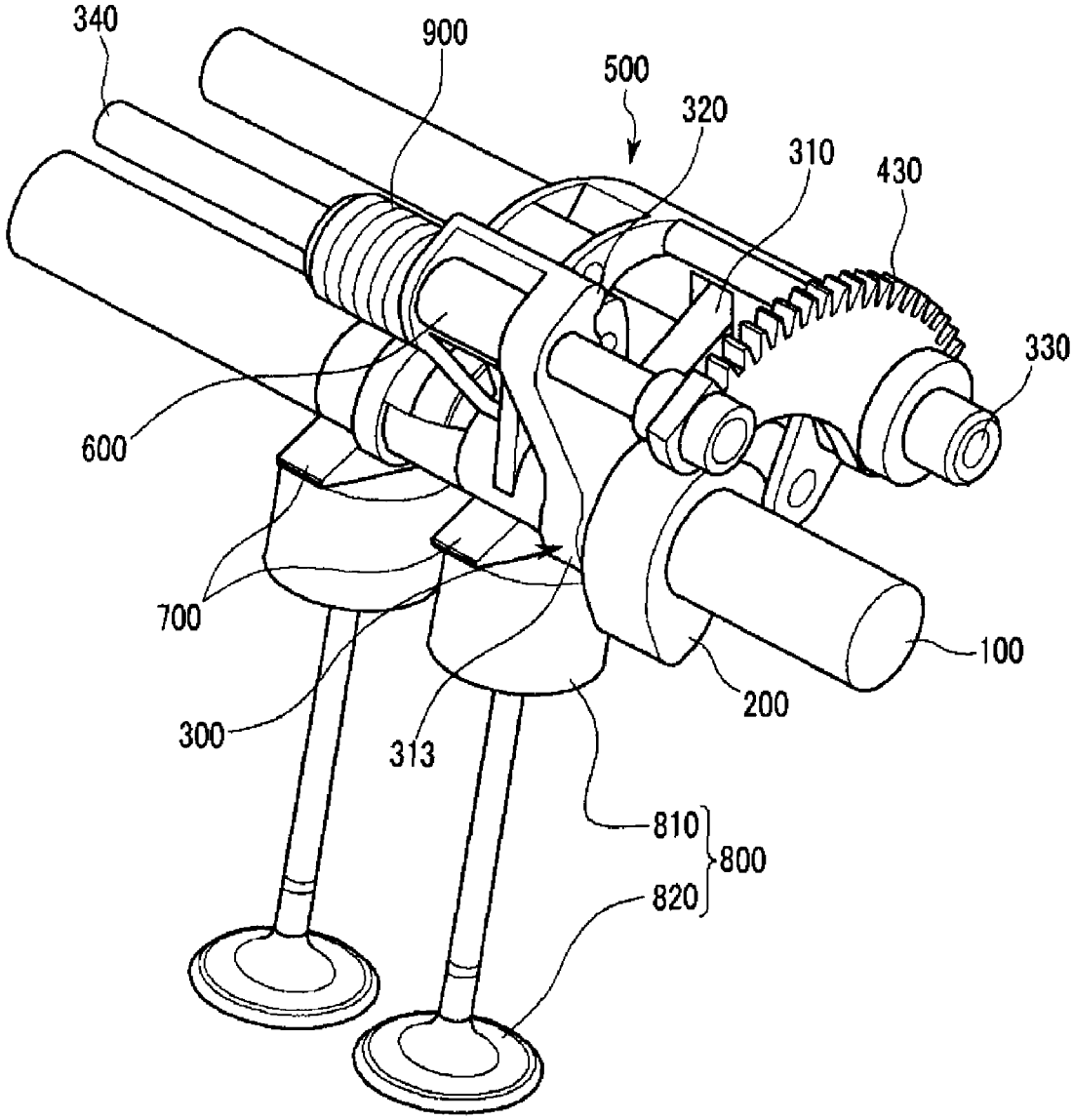
FIG. 2 is a perspective view showing a scheme of a continuous variable valve lift apparatus according to a first exemplary embodiment of the present invention except a control portion.
Figure 3:
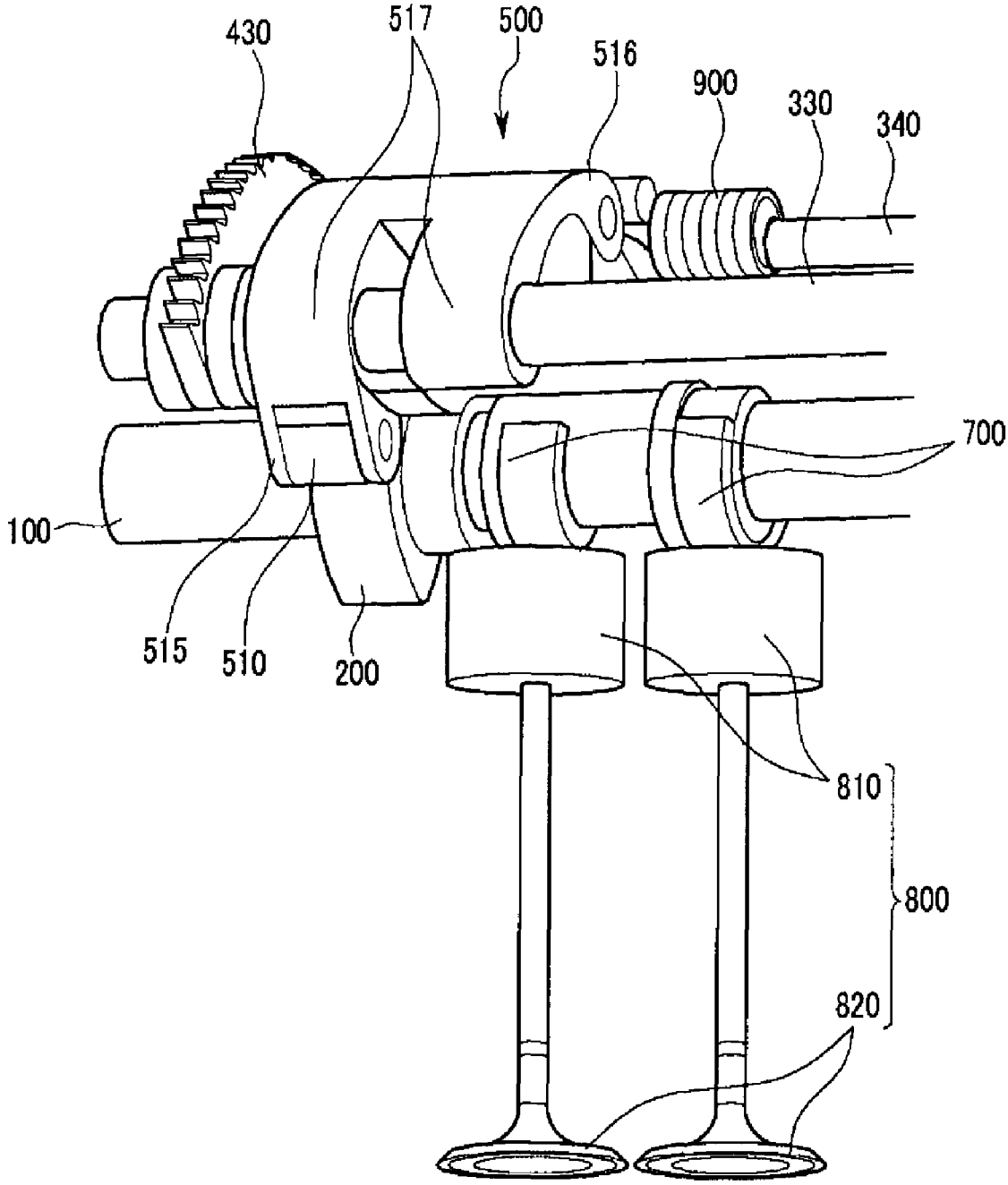
FIG. 3 is a perspective view from a different angle of FIG. 2.

FIG. 1 is a front view showing a scheme of a continuous variable valve lift apparatus according to the first exemplary embodiment of the present invention. FIG. 2 is a perspective view showing a scheme of a continuous variable valve lift apparatus according to a first exemplary embodiment of the present invention except a control portion, and FIG. 3 is a perspective view from a different angle of FIG. 2.

As shown in FIGS. 1 and 2, an input cam 200 is coaxially disposed to a camshaft 100.

A variable lever 300 which is V-shaped is disposed to the cam shaft 100. The variable lever 300 comprises a first arm 310, a second arm 320 and a connecting part 313 wherein first arm 310 and the second arm 320 are joined at the connecting part 313. The connecting part 313 of variable lever 300 is coupled to the camshaft 100.

A control portion 400 controls a relative angle of the variable lever 300 with respect to the camshaft 100 as explained in detail hereinafter.

For convenience of explanation, the relative angle is based on a horizon.

The control portion 400 includes a control motor 410 and a worm gear, and the worm gear further comprises a worm 420 connected to the control motor 410 and a worm wheel 430 coupled to the variable lever 300.

The control portion 400 controls rotation of the worm gear for regulating an angle between the variable lever 300 and the horizon.

An L-shaped first link 500 comprising a first arm 515, a second arm 516 and a connecting part 517 is coupled to the variable lever 300 via the connecting part 517.

The variable lever 300 comprising a first arm 310, a second arm 320 and a connecting part 313 which is forming a V shape is coupled to the cam shaft 100 via the connecting part 313.

The connecting part 517 of the first link 500 and distal end of first arm 310 of the variable lever 300 are rotably coupled to the first connecting shaft 330 together, and thus the first link 500 pivotally rotates with respect to the first connecting shaft 330 in response to a rotation of the input cam 200.

In an exemplary embodiment of the present invention, the worm wheel 430 is attached to the first and second connecting shafts 330 and 340.

A connecting portion is disposed for the output cam 700 to rotate in response to a rotation of the first link 500.

In an exemplary embodiment of the present invention, the connecting portion includes a second link 600. The second link 600 is coupled to the second arm 320 of the variable lever 300 via a second connecting shaft 340.

The second arm 516 of the first link 500 contacts onto the second link 600 and thus the second link 600 pivots with respect to the second connecting shaft 340 in response to a rotation of the first link 500.

Therefore, in series, the second link 600 rotates in accordance with a rotation of the first link 500 while the first link 500 rotates by operation of the input cam 200.

The second link 600 is disposed between the first link 500 and the input cam 200.

An output cam 700 is disposed coaxially to the camshaft 100 and rotates clockwise or counterclockwise for opening or closing a valve 820 in accordance with a rotation of the second link 600.

A valve opening/closing portion 800 opened or closed by a rotation of the output cam 700 includes the valve 820 and a tappet 810 integrally connected to the valve 820.

A first roller 510 may be disposed to a distal end of first arm 515 of the first link 500, and thus rotation of the input cam 200 could be smoothly transmitted to the first arm 515 of the first link 500.

A second roller 520 may be disposed to a distal end of the second arm 516 of the first link 500, and pivotal rotation of the first link 500 could be smoothly transmitted to the second link 600.

Further a third roller 610 may be disposed to a distal end of the second link 600 that contacts the output cam 700, and thus rotation of the second link 600 could be smoothly transmitted to the output cam 700.

The second link 600 may increase rotation angle of the output cam 700 by instruction of a controller so that valve lift can be increased, and the second link 600 may disperse concentrated forces which is transmitted from the input cam 200 to the output cam 700.

In contrast, the second link 600 may decrease rotation angle of the output cam 700 by instruction of a controller so that valve lift can be decreased.

The output cam 700 may include first portion 710, second portion 720 and trigger portion 730.

The first portion 710 which contacts the tappet 810 in valve-closed state, is formed at a constant distance from a rotation axis of the camshaft 100, while the second portion 720 which contacts the tappet 810 in valve-opened state, is formed in a direction away from the camshaft 100, extending from the first portion 710. The trigger portion 730 is configured to receive transmitted rotation of the second link 600.

The shape of the output cam 700 can be determined according to a driving condition of a vehicle or by experiments which can be variously embodied by a person of ordinary skill in the art based on the teachings contained herein.

A returning spring 900 is positioned at the second connecting shaft 340 and support the trigger portion 730 of the output cam 700. The output cam 700 returns to a former state by restoring force of the return spring 900 after opening the valve 820.

Referring to FIG. 2 and FIG. 3, a plurality of output cams 700 can be disposed, and a plurality of valve opening/closing portions 800 may include a plurality of valves 820 and a plurality of tappets 810 connected to the plurality of valves 820, respectively. The plurality of output cams 700 may be connected to each other for opening the plurality of valves 820 simultaneously.

Figure 4:
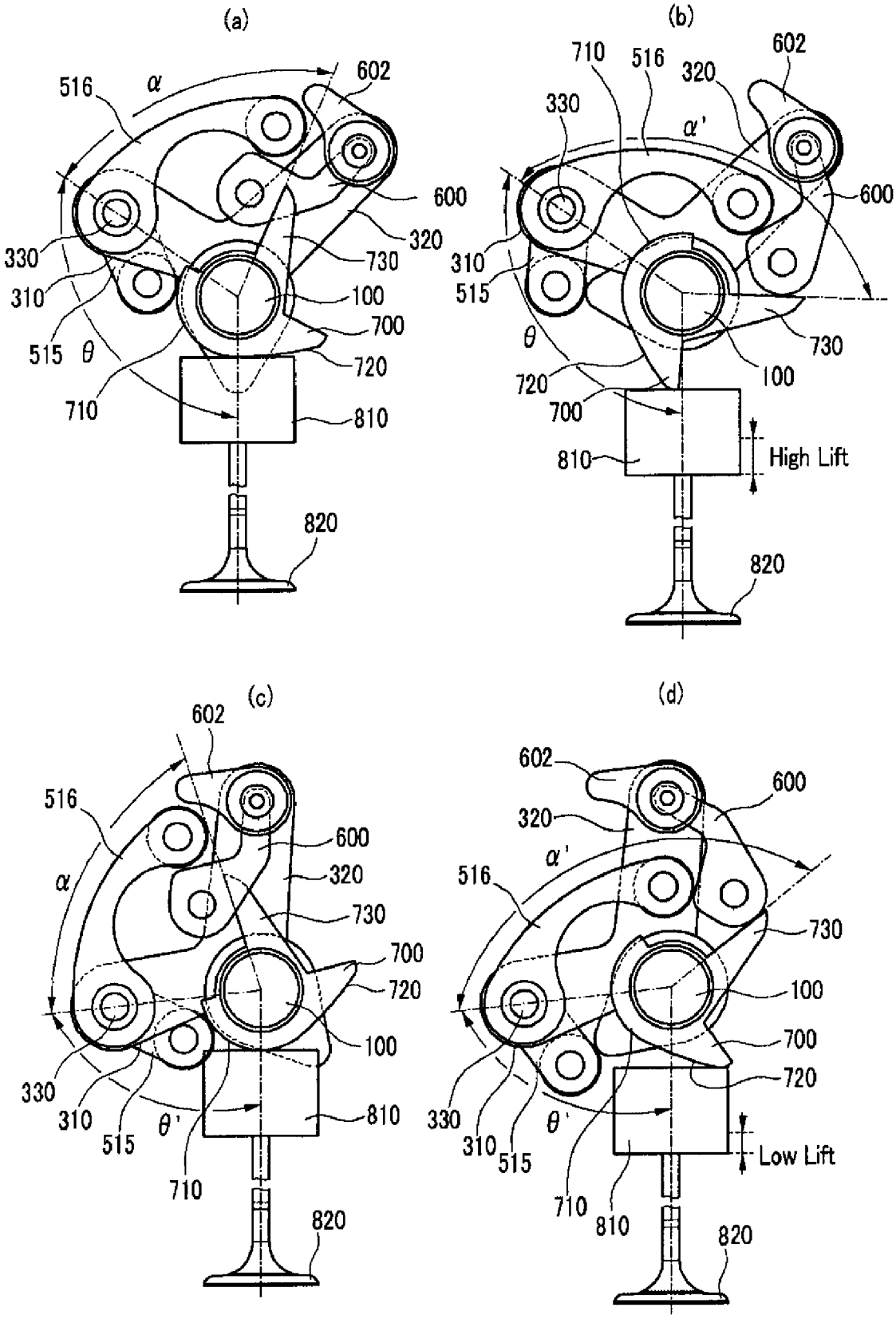
FIG. 4 is a view explaining an operation principle of the continuous variable valve lift apparatus according to the first exemplary embodiment of the present invention.

Referring to FIG. 4(*a*) to FIG. 4(*d*), an operation principle of the continuous variable valve lift apparatus according to the first exemplary embodiment of the present invention will be explained.

FIG. 4(*a*) and FIG. 4(*b*) show the valve in a closed state and the valve in an opened state in a high lift mode, respectively. FIG. 4(*c*) and FIG. 4(*d*) show the valve in a closed state and the valve in an opened state in a low lift mode, respectively.

From FIG. 4(*a*) to FIG. 4(*d*), $\ominus$ and $\ominus'$ indicate relative angles between a vertical line along a rotation center of the camshaft 100 and the valve 820 and the first connecting shaft 330. The $\alpha$ and $\alpha'$ indicate rotated angles of the output cam 700 between the first connecting shaft 330 and the trigger portion 730 of the output cam 100 when the valve 820 is in a closed state and in an opened state respectively.

In other words, the $\ominus$ and $\ominus$ determine a status of the high or low life mode and the $\alpha$ and $\alpha'$ determine a status of valve closed or opened.

Accordingly, to change a status from a low loft mode as shown in FIGS. 4(*c*) and 4(*d*) to high lift mode as shown in FIGS. 4(*a*) and 4(*b*), the variable lever 300 is regulated to rotate clockwise in drawing from $\ominus'$ to $\ominus$ by instruction of the control portion 400.

In reverse, to change a status of the high lift mode FIGS. 4(*a*) and 4(*b*) to a low lift mode as shown in FIGS. 4(*c*) and 4(*d*), the variable lever 300 is regulated to rotate counter-clockwise in drawing from $\ominus$ to $\ominus'$ by instruction of the control portion 400.

In high lift mode as shown in FIGS. 4(*a*) and 4(*b*), the output cam 700 is regulated to pivotally rotate between $\alpha$ and $\alpha'$ and thus opens or closes the valve 820.

In low lift mode as shown in FIGS. 4(*c*) and 4(*d*), the output cam 700 is regulated to pivotally rotate between $\alpha$ and $\alpha'$ and thus opens or closes the valve 820.

That is, referring to FIGS. 4(*a*)-4(*d*), rotational distance of the output cam 700, i.e., gap between $\alpha$ and $\alpha'$ is predetermined in either high lift mode or low lift mode while the relative positions of the variable lever 300, i.e., $\ominus$ and $\ominus'$ is changed corresponding to the high lift mode or low lift mode.

As explained above, the output cam 700 includes first portion 710, second portion 720 and trigger portion 730.

The first portion 710, which contacts the tappet 810, is formed at a constant distance from a rotation axis of the camshaft 100, while the second portion 720, which contacts the tappet 810, is formed in a direction away from the rotation axis of the camshaft 100, wherein the second portion 720 extends from the first portion 710 for variably opening and closing the valve 820.

The trigger portion 730 extends from the rotation axis of the cam shaft 100 substantially in radial direction therefrom.

In high lift mode as shown in FIGS. 4(*a*) and 4(*b*), i.e, when the relative rotation of the first connecting shaft 330 is at $\ominus$, the time in which the first portion 710 of the output cam 700 contacts the tappet 810 is relatively decreased. Accordingly the lift time and lift amount of the valve opening or closing may be increased.

In contrast, when the relative position of the variable lever 300 is changed from $\ominus$ to $\ominus'$ corresponding to changing modes from the high lift mode to the low lift mode, the time in which the first portion 710 of the output cam 700 contacts the tappet 810 is relatively increased. Accordingly the lift time and lift amounts of the valve opening or closing may be reduced.

The control portion 400 is controlled by an ECU (electronic control unit) on the basis of a load of an engine, vehicle speed, and so on, and an operation of the ECU is obvious to a person skilled in the art so a detailed explanation will be omitted.

The design of the output cam 700 may be variable according to the kind of vehicle or required performance of a vehicle, and if an interval of the first portion is increased, CDA (cylinder deactivation) can be achieved.

Figure 5:
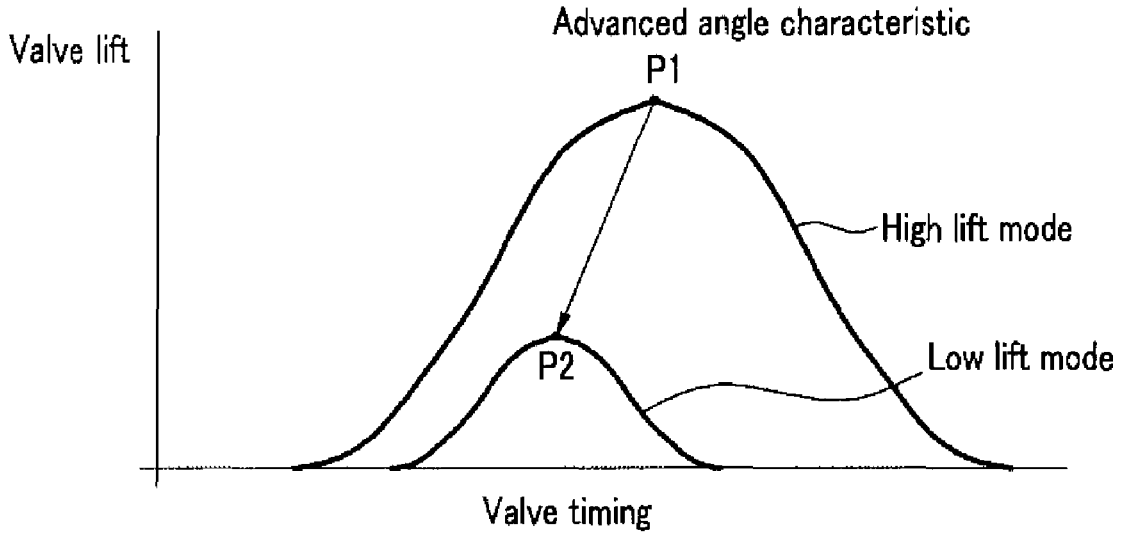
FIG. 5 is a view showing an advance angle characteristic of valve timing of the continuous variable valve lift apparatus according to the first exemplary embodiment of the present invention when a valve lift is changed.

FIG. 5 is a view showing an advance angle characteristic of valve timing of the continuous variable valve lift apparatus according to the first exemplary embodiment of the present invention when a valve lift is changed.

If the valve lift mode is changed from the high lift mode to the low lift mode as shown in FIG. 5, the variable lever 300 rotates in the opposite direction of rotation direction of the input cam 200, and thus a peak point P2 of the valve profile in low lift mode is more advanced than peak point P1 in high lift mode.

In an exemplary embodiment, an auxiliary link 602 may be placed at the second connecting shaft 340 as shown in FIG. 4.

A distal end of the auxiliary link 602 is positioned above the second arm 516 of the first link 500 and thus the auxiliary link 602 may prevent the first link 500 from separating from the second link 600 while the second arm 516 of the first link 500 contacts on the second link 600.

Figure 6:
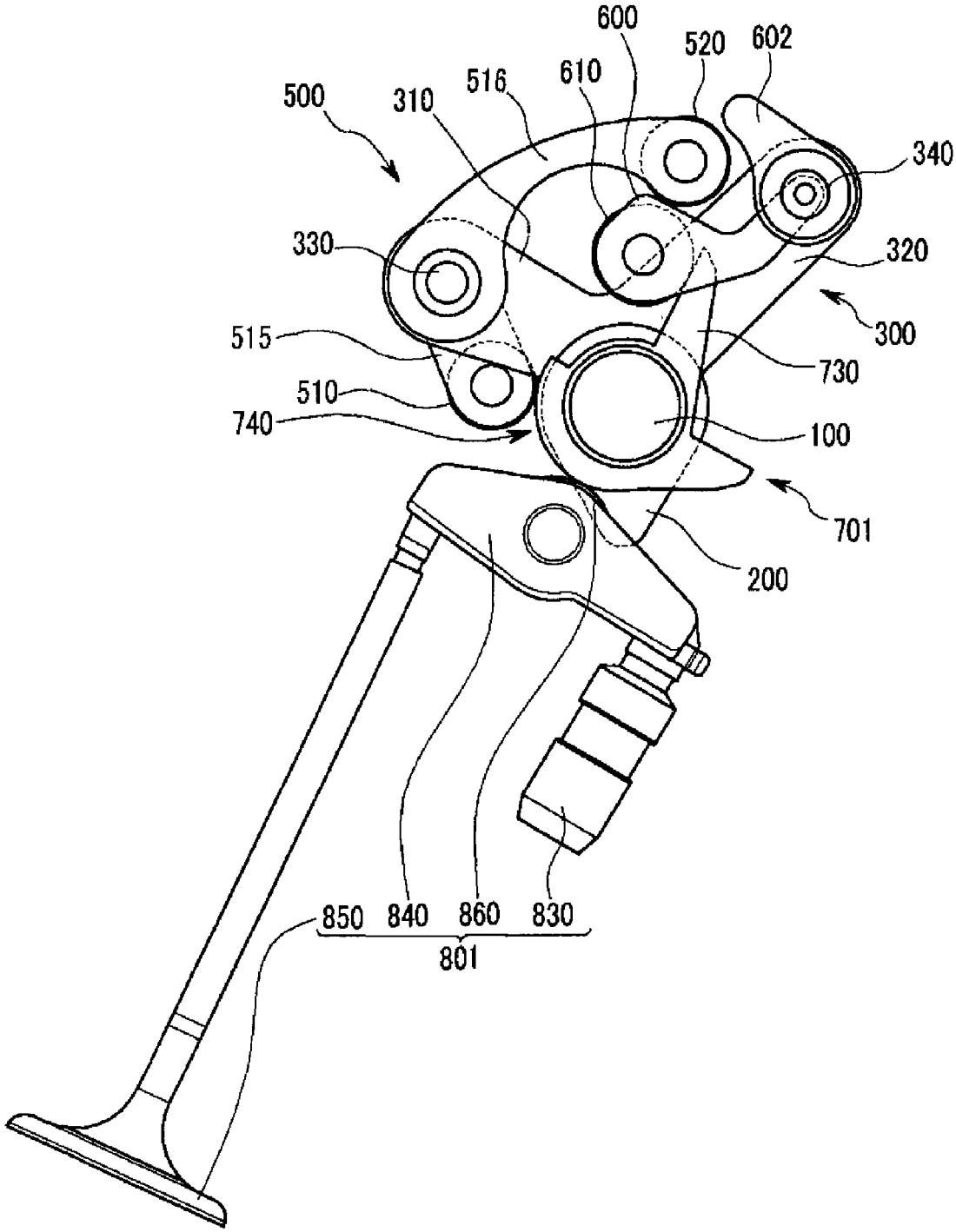
FIG. 6 is a front view of a continuous variable valve lift apparatus according to the second exemplary embodiment of the present invention.

A continuous variable valve lift apparatus according to the second exemplary embodiment of the present invention, as shown in FIG. 6, has a different valve opening/closing portion 801 and output cam 701 compared to the continuous variable valve lift apparatus according to the first exemplary embodiment of the present invention shown in FIG. 1 to FIG. 3, so the valve opening/closing portion and the output cam will be explained hereinafter.

The valve opening/closing portion 801 in FIG. 6 includes a valve 850, a swing arm 840 wherein one end of the swing arm 840 is connected to stem of the valve 850, a hydraulic lash adjuster (HLA) 830 that pivotally supports other end of the swing arm 840, and a needle bearing 860 positioned substantially at middle portion of the swing arm 840 and receives a rotation of the output cam 701, reciprocates upwards or downwards, and thus opens or closes the valve 850 in accordance with a rotation of the output cam 701.

That is, the continuous variable valve lift apparatus according to the second exemplary embodiment of the present invention can be applicable to the direct drive valve as shown in FIG. 1 to FIG. 3 as well as the swing arm valve as shown in FIG. 6.

An output cam 701 in FIG. 6 has a little bit different shape compared to the output cam 700 in FIG. 1 to FIG. 3, because a contact portion of the tappet 810 is flat and the tappet 810 reciprocates up and down by rotation of the output cam 700 in FIG. 1 to FIG. 3, but in contrast, the needle bearing 860 reciprocates up and down and moves somewhat left and right by rotation of the output cam 701 in FIG. 6 because the swing arm 840 reciprocates around the junction of the hydraulic lash adjuster 830.

Design of the output cam 731 can be realized by a skilled person in the art, so a detailed explanation will be omitted.

Hereinafter, a continuous variable valve lift apparatus according to the third exemplary embodiment of the present invention shown in FIG. 7 will be explained.

Figure 7:
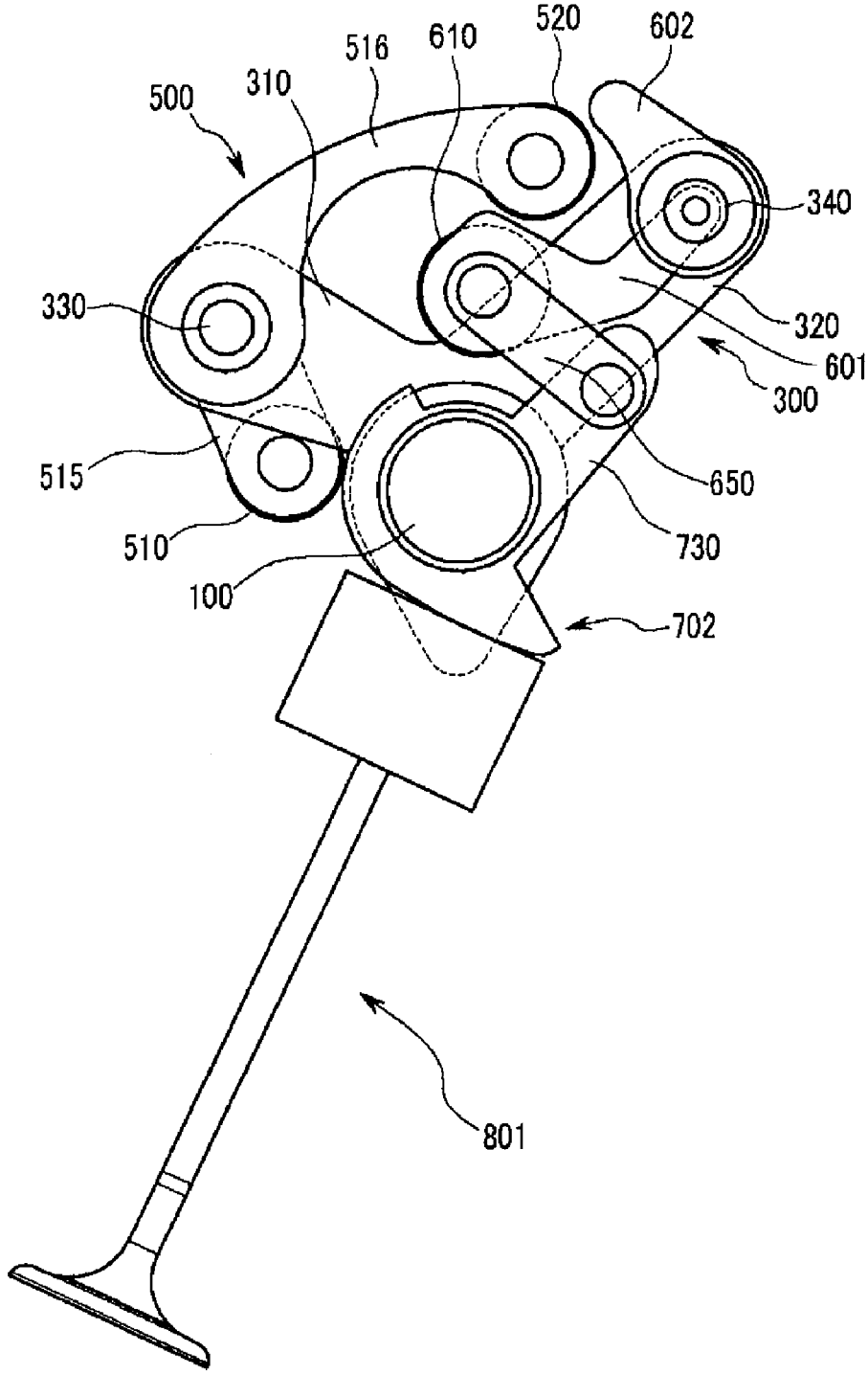
FIG. 7 is a front view of a continuous variable valve lift apparatus according to the third exemplary embodiment of the present invention.

A continuous variable valve lift apparatus according to the third exemplary embodiment of the present invention as shown in FIG. 7 has a different connecting portion and output cam, so the connecting portion and the output cam will be explained.

As shown in FIG. 7, a connecting portion includes a second link 601 and a third link 650. The third link 650 connects a distal end of the second link 601 and a distal end of a trigger portion 730 of an output cam 702. The third link 650 turns the output cam 702 in response to the operation of the first link 500 and the second link 601.

In contrast to the second embodiment illustrated in FIG. 1 and FIG. 3, the third link 650 connecting the second link 601 and an output cam 702 prevents the output cam 702 from separating the second link 601 from the output cam 702.

A continuous variable valve lift apparatus according to the fourth exemplary embodiment of the present invention comprising an auxiliary cam and an auxiliary link will now be explained.

Figure 8:
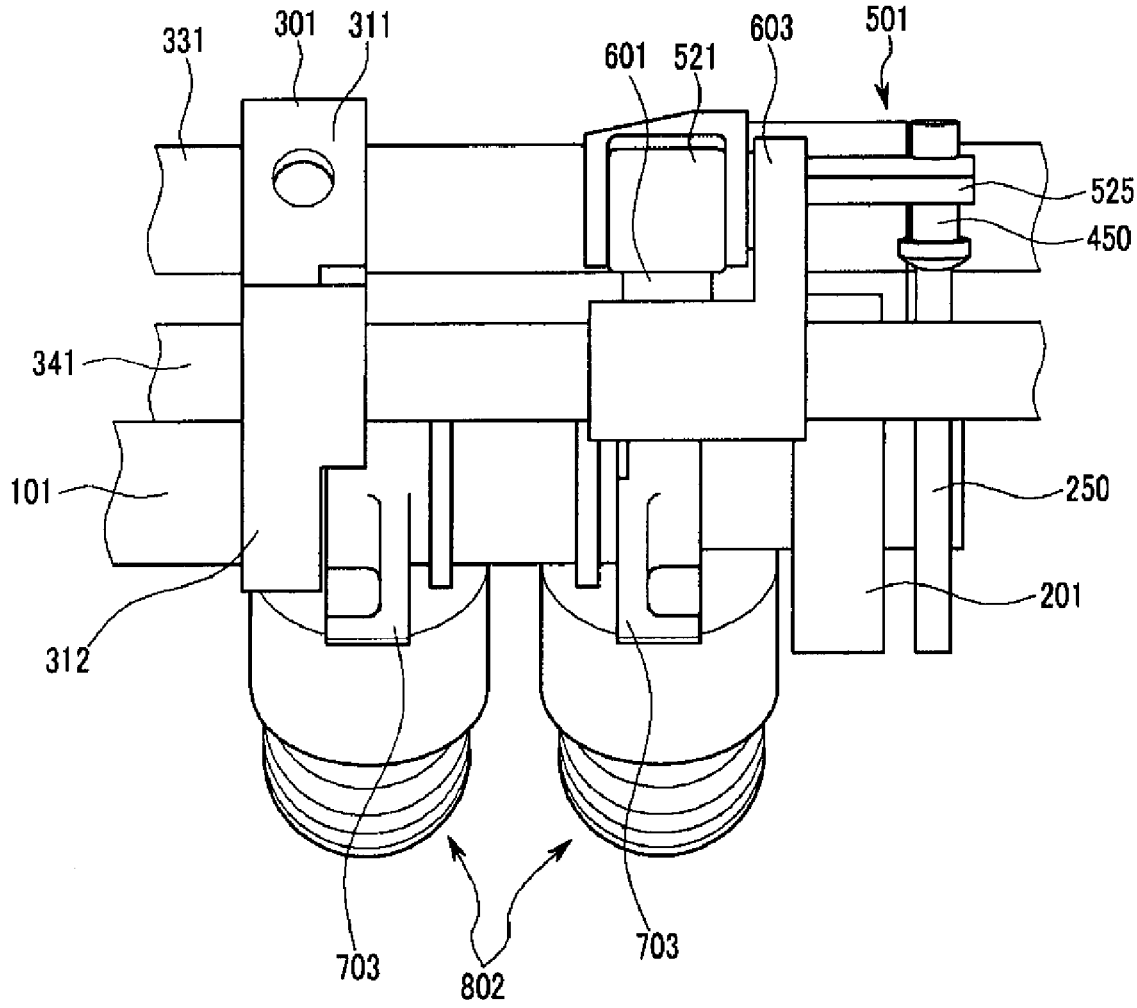
FIG. 8 is a front view of a continuous variable valve lift apparatus according to the fourth exemplary embodiment of the present invention.
Figure 9:
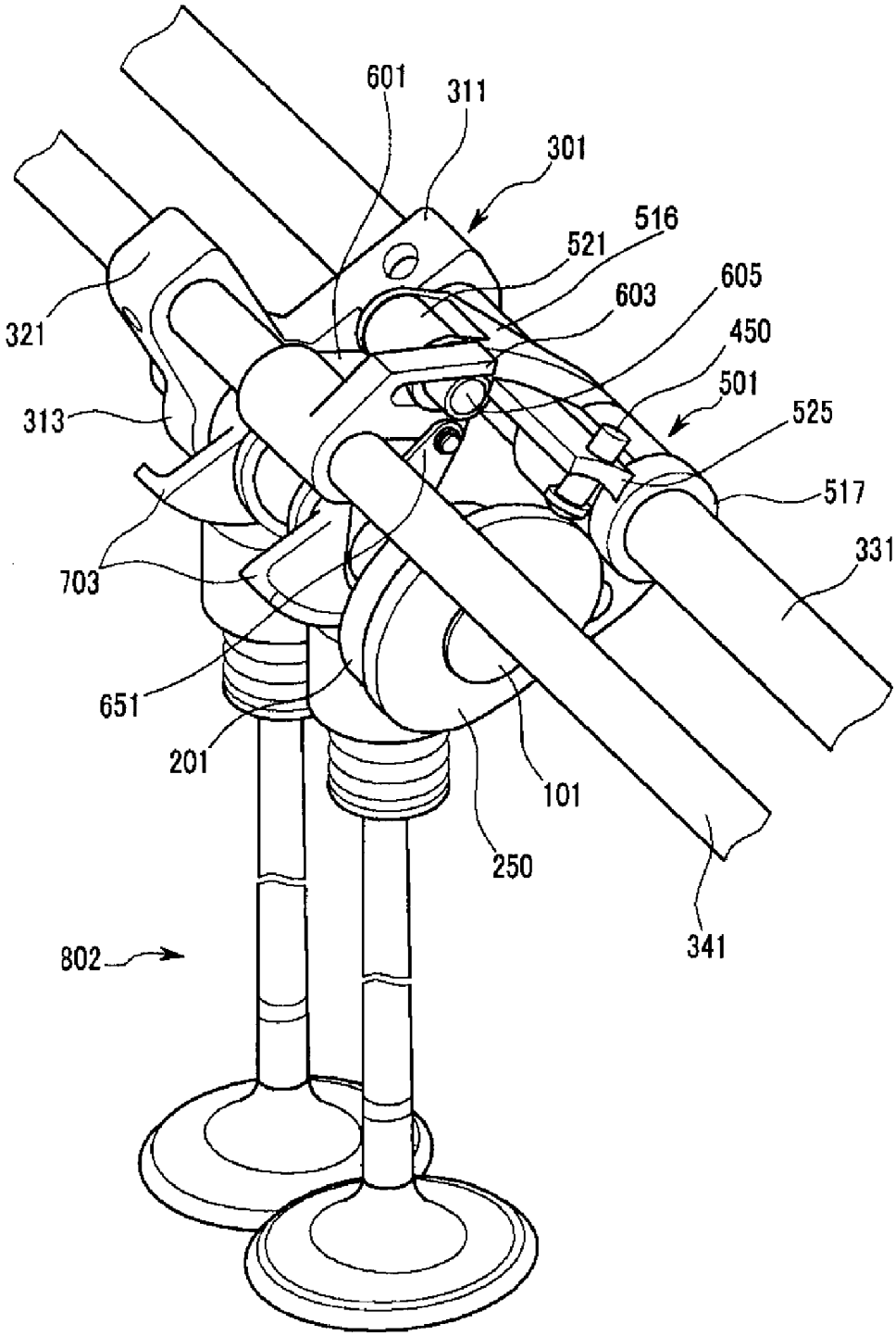
FIG. 9 is a perspective view of FIG. 8.

FIG. 8 is a front view of a continuous variable valve lift apparatus according to the fourth exemplary embodiment of the present invention, and FIG. 9 is a perspective view of FIG. 8.

Figure 10:
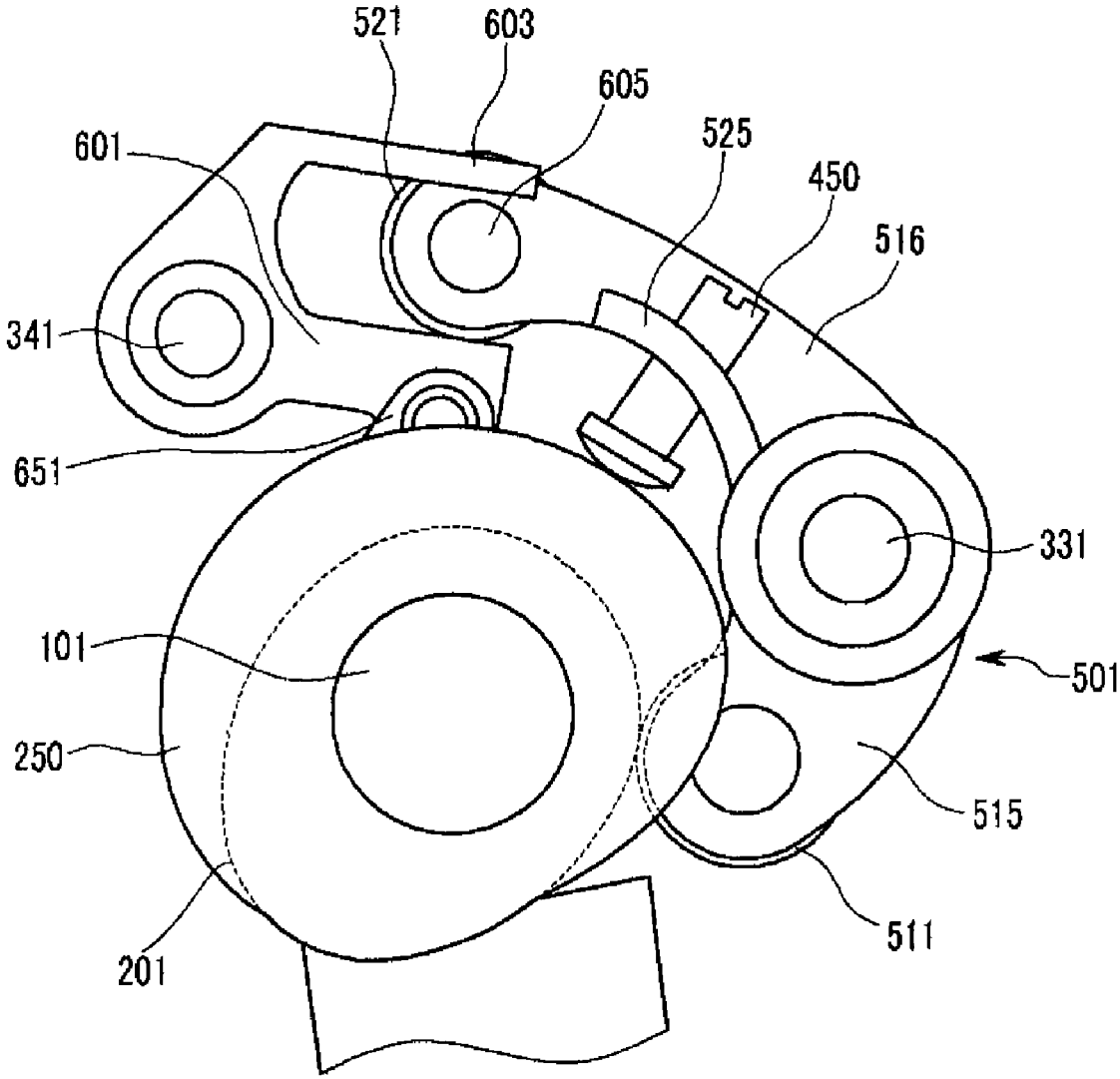
FIG. 10 is a view showing an auxiliary cam and a first link of a continuous variable valve lift apparatus according to the fourth exemplary embodiment of the present invention.

FIG. 10 is a view showing an auxiliary cam and a first link of a continuous variable valve lift apparatus according to the fourth exemplary embodiment of the present invention.

As shown in FIG. 8 to FIG. 10, an input cam 201 is coaxially disposed to a camshaft 101.

A variable lever 301 includes a first arm 311, a second arm 321 and a connecting part 313 and form substantially a V shape. The connecting part 313 of the variable lever 301 is disposed to the camshaft 101, the first arm 311 of the variable lever 301 is coupled to a first connecting shaft 331 and the second arm 321 of the variable lever 301 is coupled to a second connecting shaft 341 respectively.

The variable lever 301 is rotably connected to the camshaft 101 via the connecting part 313, and a control portion (not shown) controls a relative angle between the variable lever 301 and a horizon with respect to the camshaft 101 according to a driving condition of a vehicle.

An operation of the control portion is obvious to a skilled person in the art, so a detailed explanation will be omitted.

For convenience of explanation, the relative angle is based on a horizon.

A first link 501 comprises a first arm 515, a second arm 516, and a connecting part 517 to form substantially an L shape as already explained above.

The first link 501 is rotably coupled to the first connecting shaft 331 via the connecting part 517 and thus pivots in response to a rotation of the input cam 201.

An auxiliary cam 250 in replacement of the return spring 900 in FIG. 1, is coaxially disposed to the camshaft 101 for the first link 501 to revert to the former state after the first link 501 is turned.

A connecting portion comprising the second link 601 is disposed to the second connection shaft 341 for turning an output cam 703 in response to a rotation of the first link 501.

The output cams 703 are coaxially disposed to the camshaft 101 and open or close a valve opening/closing portion 802 in response to rotation of the output cams 703.

Accordingly, the connecting portion transmits a rotation of the first link 501 to the output cam 703.

A mounting portion is formed to the first link 501 for the first link 501 to revert to the former state corresponding to a rotation of the auxiliary cam 250.

The mounting portion comprises a mounting bracket 525 and a clearance adjusting screw 450. The mounting bracket 525 extends from a portion of the first link 501 and the clearance adjusting screw 450 is mounted at a portion of the mounting bracket for adjusting clearance between an external circumference of the auxiliary cam 250 and the first link 501.

Accordingly, the clearance can be adjusted after long operating time. Also, a continuous variable valve lift apparatus according to the exemplary embodiment of the present invention can be applicable to different kind of engines without critical design changes by adjusting the clearance.

The connecting portion includes a second link 601 wherein an end of the second link 601 is rotably coupled to the second connecting shaft 341 for receiving a rotation of the first link 501 and thus turning the output cam 703.

The connecting portion further includes a third link 651 that couples a distal end of the second link 601 and a distal end of the trigger portion 730 of the output cam 703.

The first link 501 includes a first roller 511 and the second roller 521. The first roller 511 is positioned at a distal end of the first arm 515 of the first link 501 and contacts the outer circumference of the input cam 201.

The second roller 521 of the first link 501 is positioned at a distal end of the second arm 516 of the first link 501 and the lower surface of the second roller 521 contacts an upper surface of the second link 601.

An operation of the continuous variable valve apparatus can be smoothly realized by the first roller 511 and the second roller 521.

An auxiliary link 603 may be integrally formed to the second link 601.

As shown in FIGS. 9 and 10, a link protrusion 605 may extend from an end of the second roller 521 in a longitudinal direction of the second roller 521. Diameter of the link protrusion 605 may be smaller than the diameter of the second roller 521 in an exemplary embodiment.

The auxiliary link 603 extending from an upper portion of the second link 601 is positioned above the link protrusion 605 with a predetermined gap from the link protrusion 605 for preventing the second roller 421 from separating from the second link 601.

Figure 11:
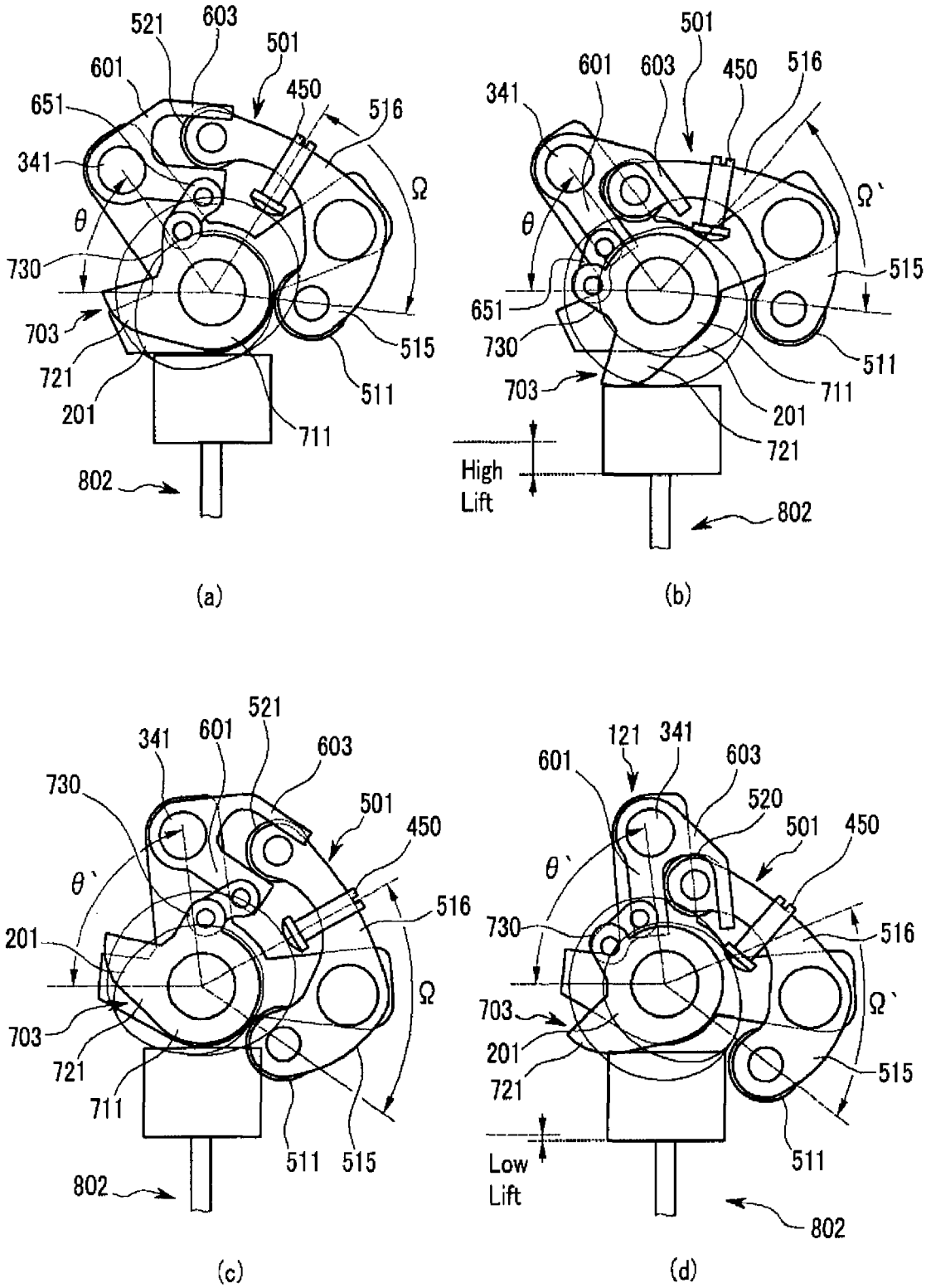
FIG. 11 is a view explaining an operation principle of the continuous variable valve lift apparatus according to the fourth exemplary embodiment of the present invention.

FIG. 11 is a view explaining an operation principle of the continuous variable valve lift apparatus according to the fourth exemplary embodiment of the present invention.

FIG. 11(*a*) and FIG. 11(*b*) show the valve in a closed state and the valve in an opened state in a high lift mode, respectively.

FIG. 11(*c*) and FIG. 11(*d*) show the valve in a closed state and the valve in an opened state in a low lift mode, respectively.

In FIG. 11(*a*) to FIG. 11(*d*), $\Theta$ and $\Theta'$ indicate relative angles between the second connecting shaft 341 and a horizon with respect to the camshaft 101 in the high lift mode and in the low lift mode, respectively.

Further $\Omega$ and $\Omega'$ indicate angles between a center of the first roller 511 and a center of the clearance adjusting screw 450 with respect to camshaft 101.

As explained above, the output cam 703 includes first and second portions 711 and 721, and a trigger portion 730. The first portion 711 has a constant radius from the rotation axis of the camshaft 101 while the second portion 721 has a gradually increased radius extending from the first portion 711 for variably opening and closing the valve opening/closing portion 802. The trigger portion 730 extends from the rotation axis of the cam shaft 100 substantially in radial direction therefrom.

A distal end of the trigger portion 730 is coupled to one end of the third link 651 which is coupled to distal end of second link 601.

FIG. 11(*a*) and FIG. 11(*b*) show the valve in a closed state and the valve in an opened state in the high lift mode, respectively.

In FIG. 11(*a*), the first link 501, which contacts the input cam 201, rotates in a counter-clockwise direction around the first connecting shaft 301 by a rotation of the input cam 201. The output cam 703 rotates in a counter-clockwise direction around the camshaft 101 corresponding to the second link 601 and the third link 651 in response to rotation of the first link 501.

FIG. 11(*c*) and FIG. 11(*d*) show the valve in a closed state and the valve in an opened state in the low lift mode, respectively.

In FIG. 11(*c*) and FIG. 11(*d*) of the low lift mode, the relative angle Θ between the second connecting shaft 341 and a horizon around the camshaft 101 in the high lift mode in FIG. 11(*a*) and FIG. 11(*b*), is increased by operation of control portion 400 in FIG. 11(*c*) and FIG. 11(*d*).

However, the relative rotation angle between a center of the first roller 511 and a center of the clearance adjusting screw 450 with respect to camshaft 101, i.e,. the angle difference between Ω and Ω' is constant either in the high lift mode or in the low lift mode even if the relative angles of the second connecting shift 341, i.e., Θ and Θ' are changed corresponding to the high lift mode or low lift mode.

Thus, when a relative position of the variable lever 301 is changed according to changing of modes from high lift mode to low lift mode, the time during which the first portion 711 of the valve opening/closing portion 802 contacts the tappet 810 is relatively increased. The valve opening/closing portion 802 maintains a closed state, and the time and lift amounts of valve opening may be reduced.

The design of the output cam may be variable according to the kind of vehicle or required performance of a vehicle, and if an interval of the first portion is increased, CDA (cylinder deactivation) can be achieved.

Determining the shape of the auxiliary cam 250 will now be explained.

When the input cam 201 rotates to contact the first roller 511, the clearance adjusting screw 450 rotates and forms a trace at the same time. The shape of the auxiliary cam 250 that contacts the clearance adjusting screw 450 and rotates around the rotation axis of the camshaft 101 can be obtained from the obtained trace and a center of the camshaft 101. In accordance with the contour of the auxiliary cam 250, the first link 501 may revert to the former state.

Figure 12:
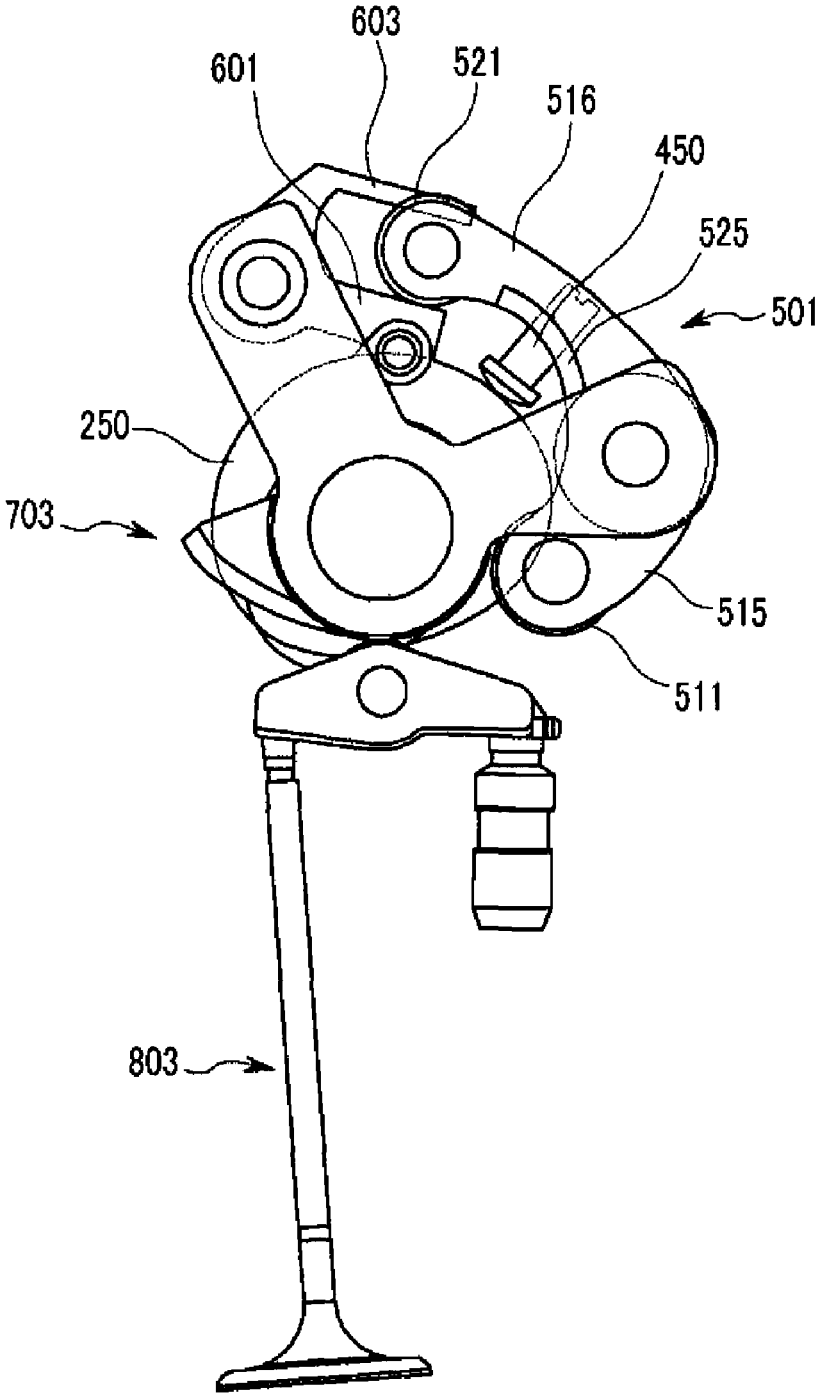
FIG. 12 is a view of a continuous variable valve lift apparatus according to the fifth exemplary embodiment of the present invention.

FIG. 12 is a view of a continuous variable valve lift apparatus according to the fifth exemplary embodiment of the present invention.

The valve opening/closing portion 802 can be a direct drive valve as shown in FIG. 9, and a valve opening/closing portion 803 can be a swing arm valve as shown in FIG. 12.

Figure 13:
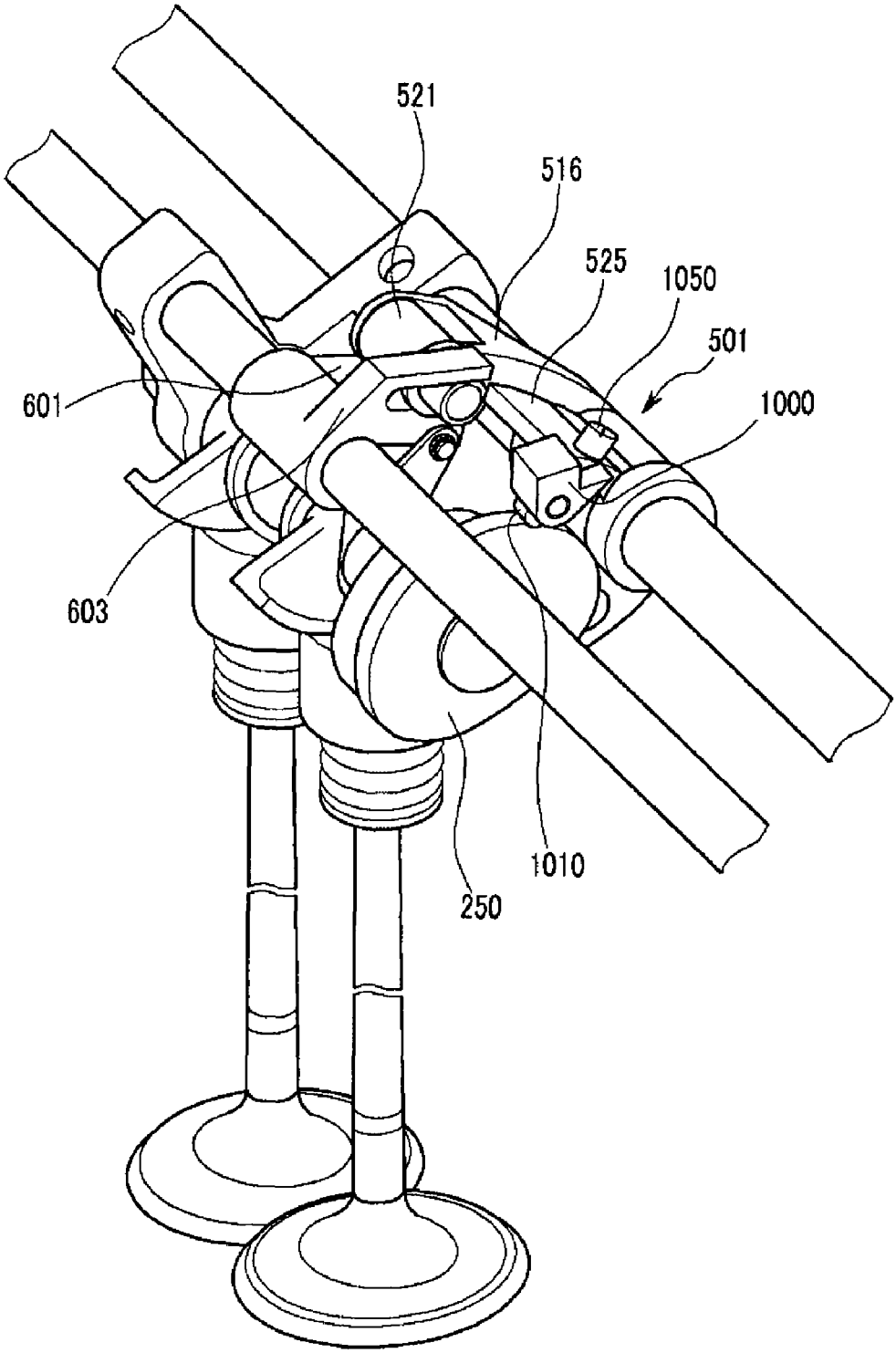
FIG. 13 is a perspective view of a continuous variable valve lift apparatus according to the sixth exemplary embodiment of the present invention.

FIG. 13 is a perspective view of a continuous variable valve lift apparatus according to the sixth exemplary embodiment of the present invention.

The configuration of the continuous variable valve lift apparatus according to the sixth exemplary embodiment of the present invention is similar to the continuous variable valve lift apparatus according to the fifth exemplary embodiment of the present invention, so differences between the sixth exemplary embodiment and the fifth exemplary embodiment of the present invention will be explained.

The continuous variable valve lift apparatus according to the sixth exemplary embodiment of the present invention includes a fourth link 1000 that is formed to the first link 501 for the first link 501 to revert to the former state corresponding to a rotation of the auxiliary cam 250. In an exemplary embodiment of the present invention, the fourth link 1000 may be coupled to the mounting bracket 525 connected to the first link 501.

A fourth roller 1010 may be disposed to a lower portion of the fourth link 1000 that contacts the auxiliary cam 250, and thus rotation of the auxiliary cam 250 is smoothly transmitted to the fourth link 1000. A clearance adjusting screw 1050 is disposed to the first link 503 for adjusting clearance between the fourth link 1000 and the first link 501.

Therefore, a clearance between the fourth link 1000 and the first link 501 can be adjusted after long operating period by adjusting length of the clearance adjusting screw 1050, Also, a continuous variable valve lift apparatus according to the exemplary embodiment of the present invention can be applicable to different kind of engines without critical design changes.

The operation and configuration of the continuous variable valve lift apparatus according to the sixth exemplary embodiment of the present invention are similar to those of the continuous variable valve lift apparatus according to the first to fifth exemplary embodiments of the present invention, so a detailed explanation will be omitted.

Figure 14:
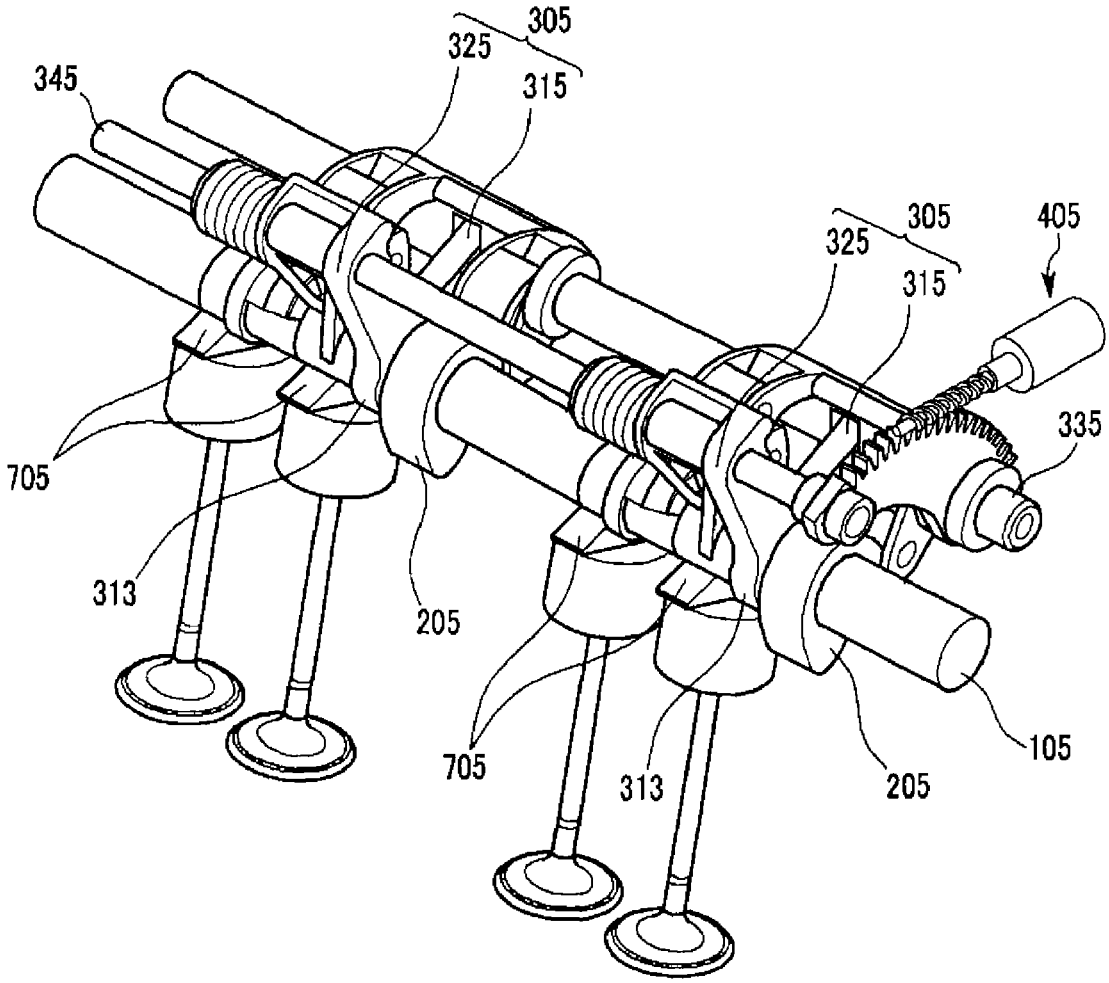
FIG. 14 is a view of a continuous variable valve lift apparatus according to the seventh exemplary embodiment of the present invention.

FIG. 14 is a view of a continuous variable valve lift apparatus according to the seventh exemplary embodiment of the present invention.

According to the seventh exemplary embodiment of the present invention in FIG. 14, a plurality of continuous variable valve lift apparatuses of the first exemplary embodiment of the present invention in FIG. 3 are disposed, and the plurality of continuous variable valve lift apparatuses can open and close a plurality of valves in a valve train.

The continuous variable valve lift apparatus according to the seventh exemplary embodiment of the present invention includes a camshaft 105, a plurality of input cams 205 disposed to the camshaft 105, and a plurality of variable levers 305 wherein connecting parts 313 of the variable lever 305 are rotably connected to the camshaft 105 and include a first arm 315 coupled to a first connecting shaft 335 and a second arm 325 coupled to a second connecting shaft 345, respectively.

The plurality of variable levers 305 are connected to each other by a lever connecting shaft and are simultaneously controlled by single control portion 405.

The lever connecting shaft may be the first connecting shaft 335 and/or the second connecting shaft 345, and connects the plurality of variable levers 305.

The plurality of output cams 705 are disposed to the camshaft 105 for opening or closing valves in each cylinder.

The operation and configuration of the continuous variable valve lift apparatus according to the seventh exemplary embodiment of the present invention are similar to those of the continuous variable valve lift apparatus according to the first to sixth exemplary embodiments of the present invention, so a detailed explanation will be omitted.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

According to the exemplary embodiments of the present invention, elements are configured around a camshaft with a simple structure, and the continuous variable valve lift apparatus can be configured without significant design changes of a conventional valve train.

A small number of elements can be used, so production cost and maintaining cost can be reduced.

Advance characteristics of valve timing can be realized when valve lift is reduced according to a position change of the variable lever.

One control portion can control valve lift in each cylinder.

A direct drive valve and a swing arm valve can be applicable, valve lift can be adjusted with small design change in the second link of the output cam, and a CDA mode can be realized.

The continuous variable valve lift apparatus according to the fourth exemplary embodiment of the present invention and the fifth exemplary embodiment can be realized without a return spring, so that friction loss can be reduced and fuel consumption efficiency can be improved in a low lift mode.

What is claimed is:

1. A continuous variable valve lift apparatus comprising:

a camshaft;

an input cam disposed to the camshaft coaxially;

a variable lever comprising a first arm, a second arm and a connecting part wherein the variable lever is rotably connected to the camshaft via the connecting part and the first arm is coupled to a first connecting shaft and the second arm is coupled to a second connecting shaft;

a first link coupled to the first connecting shaft and rotating around the first connecting shaft in response to a rotation of the input cam;

a connecting portion pivotally coupled to the second arm of the variable lever;

an output cam coaxially coupled to the camshaft and rotating around the camshaft in accordance with rotation of the connection portion which is transmitted by the first link;

a valve opening/closing portion that is opened or closed corresponding to a rotation of the output cam.

2. The continuous variable valve lift apparatus of claim 1, wherein the first link comprises a first arm, a second arm and a connecting part and the connecting part of the first link is configured to connect the first and second arms of the first link to the first connecting shaft.

3. The continuous variable valve lift apparatus of claim 2, wherein the first link further comprises:

a first roller that is positioned at a distal end of the first arm of the first link and contacts the input cam; and a second roller that is positioned at a distal end of the second arm of the first link and contacts the connecting portion.

4. The continuous variable valve lift apparatus of claim 1, wherein the connecting portion comprises a second link wherein one end of the second link is coupled to the second connecting shaft and a distal end of the second link rotates around the second connecting shaft and transmits rotation of the first link to the output cam.

5. The continuous variable valve lift apparatus of claim 4, wherein the second link of the connecting portion is disposed substantially between the first link and the output cam.

6. The continuous variable valve lift apparatus of claim 4, wherein the second link of the connecting portion comprises a third roller at the distal end of the second link and the third roller contacts the output cam.

7. The continuous variable valve lift apparatus of claim 1, wherein the connecting portion comprises:

a second link, wherein one end of the second link is coupled to the second connecting shaft and a distal end of the second link rotates around the second connecting shaft corresponding to rotation of the first link; and a third link that is coupled to the distal end of the second link and the output cam and turns the output cam corresponding to rotation of the second link.

8. The continuous variable valve lift apparatus of claim 1, further comprises a control portion comprising a control motor and a worm gear that couples the control motor and the variable lever to control a rotational displacement of the variable lever.

9. The continuous variable valve lift apparatus of claim 1, wherein the output cam comprises:

a first portion having a constant distance from a rotation axis of the camshaft and contacting the valve opening/closing portion in a valve-closing state;

a second portion formed in a direction away from the camshaft, extending from the first portion and contacting the valve opening/closing portion in a valve-opening state; and a trigger portion formed in a radial direction away from the camshaft and receiving a rotation of the connecting portion.

10. The continuous variable valve lift apparatus of claim 1, wherein a return spring is disposed to the second connecting shaft and supplies a restoring force to the output cam.

11. The continuous variable valve lift apparatus of claim 1, wherein the valve opening/closing portion comprises a valve and a tappet that is connected to the valve in a longitudinal axis of the valve and opens or closes the valve corresponding to rotation of the output cam.

12. The continuous variable valve lift apparatus of claim 1, wherein the valve opening/closing portion comprises:

a valve;

a swing arm wherein one end of the swing arm is connected to the valve;

a hydraulic lash adjuster wherein other end of the swing arm is connected to the hydraulic lash adjuster and the hydraulic lash adjuster supports the swing arm; and a needle bearing positioned substantially at a middle portion of the swing arm, wherein the needle bearing reciprocates up or down in accordance with a rotation of the output cam and thus opens or closes the valve.

13. The continuous variable valve lift apparatus of claim 1, further comprising an auxiliary cam that is disposed to the camshaft coaxially and controls rotation of the first link to revert the first link to a former state after the first link turns the output cam.

14. The continuous variable valve lift apparatus of claim 13, wherein a mounting portion is formed to the first link and tracks a contour of the auxiliary cam so that the first link reverts to a former state in accordance with a rotation of the auxiliary cam.

15. The continuous variable valve lift apparatus of claim 14, wherein the mounting portion comprises:

a mounting bracket attached to the first link; and a clearance adjusting screw placed at the mounting bracket, facing toward the auxiliary cam for controlling clearance between the auxiliary cam and the first link.

16. The continuous variable valve lift apparatus of claim 14, wherein the first link comprises a first arm, a second arm and a connecting part and the connecting part of the first link is configured to connect the first and second arms of the first link.

17. The continuous variable valve lift apparatus of claim 16, wherein the first link further comprises:

a first roller positioned at a distal end of the first arm of the first link, wherein the first roller contacts the input cam; and a second roller positioned at a distal end of the second arm of the first link, wherein the second roller contacts the connecting portion.

18. The continuous variable valve lift apparatus of claim 17, wherein the connecting portion comprises:

a second link that is coupled to the second connecting shaft and a distal end of the second link rotates around the second connecting shaft corresponding to rotation of the first link; and a third link that is coupled to the distal end of the second link and the output cam and turns the output cam corresponding to rotation of the second link.

19. The continuous variable valve lift apparatus of claim 18, wherein an auxiliary link is placed at the second connecting shaft and the second roller of the first link is positioned under a distal end of the auxiliary link for preventing the first link from separating from the second link.

20. The continuous variable valve lift apparatus of claim 18, wherein an auxiliary link is formed to integrally extend from an upper portion of the second link and the second link receives a lower portion of the second roller of the first link and the auxiliary link is positioned above a link protrusion of the second roller with a predetermined clearance for preventing the first link from separating from the second link.

21. The continuous variable valve lift apparatus of claim 20, wherein the link protrusion extends from the second roller along a rotation axis of the second roller.

22. The continuous variable valve lift apparatus of claim 14, wherein the valve opening/closing portion is a direct drive valve.

23. The continuous variable valve lift apparatus of claim 14, wherein the valve opening/closing portion is a swing arm valve.

24. The continuous variable valve lift apparatus of claim 13, wherein a fourth link is formed to the mounting bracket of the first link for the first link to revert to the former state corresponding to a rotation of the auxiliary cam.

25. The continuous variable valve lift apparatus of claim 24, wherein a fourth roller is disposed to the fourth link to contact the auxiliary cam.

26. The continuous variable valve lift apparatus of claim 25, wherein a clearance adjusting screw is disposed to the mounting bracket of the first link for adjusting clearance between the fourth link and the auxiliary cam.

27. The continuous variable valve lift apparatus of claim 26, wherein the first link further comprises a first roller that is positioned at a distal end of the first arm and contacts the input cam and a second roller that is positioned at a distal end of the second arm and contacts the connecting portion.

28. The continuous variable valve lift apparatus of claim 27, wherein the connecting portion comprises:

a second link that is coupled to the second connecting shaft and a distal end of the second link rotates around the second connecting shaft corresponding to rotation of the first link; and a third link that is coupled to the distal end of the second link and the output cam and turns the output cam corresponding to rotation of the second link.

29. The continuous variable valve lift apparatus of claim 28, wherein an auxiliary link is placed at the second connecting shaft and the second roller of the first link is positioned under a distal end of the auxiliary link for preventing the first link from separating from the second link.

30. The continuous variable valve lift apparatus of claim 28, wherein an auxiliary link is formed to integrally extend from an upper portion of the second link and the second link receives a lower portion of the second roller of the first link and the auxiliary link is positioned above a link protrusion of the second roller with a predetermined clearance for preventing the first link from separating from the second link.

31. The continuous variable valve lift apparatus of claim 30, further comprising an auxiliary cam that is disposed to the camshaft coaxially and controls rotation of at least the first link to revert the first link to the former state after the first link turns the output cam.

32. A continuous variable valve lift apparatus comprising:

a camshaft;

a plurality of input cams disposed to the camshaft coaxially;

a plurality of variable levers, wherein the variable lever comprises a first arm, a second arm and a connecting part wherein the variable lever is rotably connected to the camshaft via the connecting part and the first arm is coupled to a first connecting shaft and the second arm is coupled to a second connecting shaft;

a control portion that controls an angle between the variable lever and a horizon;

a plurality of the first link coupled to the first connecting shaft and rotating around the first connecting shaft in response to a rotation of the input cam;

a plurality of the second links rotating around the second connecting shaft corresponding to rotations of the plurality of first links;

an output cam coaxially coupled to the camshaft and rotating around the camshaft in accordance with rotation of the plurality of second links which are transmitted by the first links; and a plurality of valve opening/closing portions that are opened or closed corresponding to rotations of the plurality of output cams, wherein the plurality of variable levers are connected to each other by a lever connecting shaft and are controlled by the control portion.

* * * * *